US008322716B2

(12) United States Patent
Miwa

(10) Patent No.: US 8,322,716 B2
(45) Date of Patent: Dec. 4, 2012

(54) IMAGE FORMING APPARATUS

(75) Inventor: Atsushi Miwa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 98 days.

(21) Appl. No.: 12/832,542

(22) Filed: Jul. 8, 2010

(65) Prior Publication Data

US 2010/0270727 A1 Oct. 28, 2010

Related U.S. Application Data

(62) Division of application No. 12/146,906, filed on Jun. 26, 2008, now Pat. No. 7,775,516.

(30) Foreign Application Priority Data

Jun. 28, 2007 (JP) ..... 2007-170874

(51) Int. Cl.
*B65H 5/00* (2006.01)

(52) U.S. Cl. ..... 271/264; 271/125

(58) Field of Classification Search ..... 271/145, 271/162, 264, 273, 274, 124, 125, 225
See application file for complete search history.

(56) References Cited

U.S. PATENT DOCUMENTS 4,614,334 A * 9/1986 Henmi et al. ..... 271/8.1
5,370,381 A * 12/1994 Winship et al. ..... 271/121
5,620,174 A * 4/1997 Taniguro et al. ..... 271/10.12
5,725,208 A * 3/1998 Miyauchi ..... 271/10.09
5,734,404 A * 3/1998 Komuro et al. ..... 347/104
5,884,909 A * 3/1999 Umeda ..... 271/242
5,988,635 A * 11/1999 Ohshima ..... 271/274
6,257,569 B1 * 7/2001 Rhodes et al. ..... 271/117
6,293,541 B1 * 9/2001 Horiuchi et al. ..... 271/184
7,216,864 B2 5/2007 Yoshihara
7,427,060 B2 * 9/2008 Taniyama ..... 271/122
7,464,927 B2 * 12/2008 Ito et al. ..... 271/171
7,515,865 B2 * 4/2009 Matsushima et al. ..... 399/381
7,539,448 B2 * 5/2009 Miwa et al. ..... 399/316
7,597,313 B2 * 10/2009 Dan ..... 271/10.03
2004/0041334 A1 * 3/2004 Yoshihara ..... 271/145
2004/0041338 A1 * 3/2004 Lin et al. ..... 271/264

(Continued)

FOREIGN PATENT DOCUMENTS

JP 57112252 A * 7/1982

(Continued)

OTHER PUBLICATIONS

JP Office Action dtd Apr. 16, 2009, JP Appln. 2007-170874, partial translation.

*Primary Examiner* — Prasad Gokhale
(74) *Attorney, Agent, or Firm* — Banner & Witcoff, Ltd.

(57) ABSTRACT

An image forming apparatus is provided. The image forming apparatus includes a body including a conveyance path into which a sheet is conveyed and a feed tray. The feed tray includes a separation pad, which is provided at a widthwise center of the feed tray; and a holding member, which is provided downstream of the separation pad in a direction of conveyance of the sheet, the holding member comprising a driven roller, which is wider than the separation pad, and at least two guide members, one guide member arranged on each side of the driven roller.

15 Claims, 12 Drawing Sheets

U.S. PATENT DOCUMENTS

| | | | | |
|---|---|---|---|---|
| 2005/0051944 | A1* | 3/2005 | Makino et al. | 271/10.01 |
| 2005/0220517 | A1* | 10/2005 | Matsushima et al. | 399/388 |
| 2006/0113723 | A1* | 6/2006 | Ito et al. | 271/162 |
| 2006/0157915 | A1* | 7/2006 | Ogawa | 271/126 |
| 2008/0036141 | A1* | 2/2008 | Liu et al. | 271/274 |
| 2008/0284091 | A1* | 11/2008 | Sekiyama et al. | 271/226 |
| 2009/0033023 | A1* | 2/2009 | Shirasaki | 271/145 |

FOREIGN PATENT DOCUMENTS

| | | | |
|---|---|---|---|
| JP | 61-068040 | U | 5/1986 |
| JP | 02038230 | A * | 2/1990 |
| JP | 05-096857 | | 12/1993 |
| JP | 06-003951 | | 1/1994 |
| JP | 06-009101 | | 1/1994 |
| JP | 07-251976 | | 10/1995 |
| JP | 9-272642 | A | 10/1997 |
| JP | 11-165908 | | 6/1999 |
| JP | 2000-219382 | | 8/2000 |
| JP | 2003-212376 | | 7/2003 |
| JP | 2004-091126 | A | 3/2004 |
| JP | 2004-269098 | | 9/2004 |
| JP | 2005-162354 | A | 6/2005 |
| JP | 2007-106551 | | 4/2007 |

* cited by examiner

IMAGE FORMING APPARATUS

CROSS REFERENCE TO RELATED APPLICATION

This application is a divisional of prior U.S. application Ser. No. 12/146,906, filed Jun. 26, 2008, which claims priority from Japanese Patent Application No. 2007-170874, which was filed on Jun. 28, 2007, the disclosure of which is herein incorporated by reference in its entirety.

TECHNICAL FIELD

Apparatuses and devices consistent with the present invention relate to an image forming apparatus.

BACKGROUND

Japanese unexamined utility model application publication No. JP-UM-A-5-96857 (hereinafter, Patent Document 1) and Japanese unexamined patent application publication No. JP-A-2000-219382 (hereinafter, Patent Document 2) describe related art image forming apparatuses. The related art image forming apparatus described in Patent Document 1 includes a conveyance unit which conveys each sheet along a conveyance path; and an image forming unit such as a photoconductive drum, a transfer unit, etc. which forms an image on the sheet while the sheet is conveyed by the conveyance unit. A feed roller and a sheet guide are provided in the conveyance path. The feed roller conveys the sheet. The sheet guide is located on a downstream side of the feed roller with respect to a sheet conveyance direction. The sheet guide guides the sheet to the conveyance path.

The related art image forming apparatus described in Patent Document 2 is configured so that each sheet is guided by a guide plate in a turn portion which changes a conveyance direction in the middle of conveyance of the sheet.

When a firm thick sheet is used in the related art image forming apparatus described in the Patent Document 1, collision noise sometimes occurs because a trailing end of the sheet bounces due to an elastic force of the sheet as the sheet suddenly collides with the sheet guide after the trailing end of the sheet passes through the feed roller. The term "trailing end of the sheet" denotes an end portion of the sheet which is located on a rear or downstream side with respect to the sheet conveyance direction when the sheet is conveyed along the conveyance path.

In order to reduce the collision noise, Patent Document 1 provides a shock absorbing unit between the feed roller and the photoconductive drum. The shock absorbing unit absorbs shock when the sheet passes through the feed roller. The shock absorbing unit is rotatably supported on a rotary shaft of the feed roller. When the trailing end of the sheet passes through the feed roller, the shock absorbing unit presses the trailing end portion of the sheet downward using only the weight of the shock absorbing unit itself. Then, the trailing end of the sheet thus presses against the shock absorbing unit providing a counterforce against the weight of the shock absorbing unit so as to rotate the shock absorbing unit upward. Accordingly, the upward rotation of the shock absorbing unit cancels the elastic force by which the trailing end of the sheet is bounced up. As a result, the trailing end of the sheet can be prevented from being bounced up suddenly, so that the trailing end of the sheet can be restrained from colliding with the sheet guide.

However, the above collision noise caused by collision of the sheet bouncing in the conveyance path is not limited to the location described in Patent Document 1. For example, in a related art image forming apparatus, a feed tray on which sheets are received is provided so as to be detachably attached to a main body of the apparatus. Each sheet is received by the conveyance path of the body from the feed tray. Accordingly, a difference in level is provided between the feed tray and the conveyance path in order to prevent the conveyance path from blocking a leading end of the sheet that is conveyed to the conveyance path from the feed tray. In this configuration, collision noise is caused by collision of the sheet with the conveyance path on the main body when the sheet passes through the level difference portion. This level difference portion is also sometimes referred to as a step portion between the feed tray and the conveyance path.

To prevent such collision noise in the step portion, for example, Patent Document 2 describes a related art image forming apparatus having configuration in which the step portion of the guide plate is inclined with respect to the widthwise direction of the sheet. However, in Patent Document 2, a roller is provided in the middle of the guide plate, and a level difference is formed between the roller and the guide plate. Accordingly, there is a case in which collision noise is caused by collision of the sheet with the guide plate when the sheet passes through the roller.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus in which collision noise of each sheet can be reduced.

According to an exemplary embodiment of the present invention, there is provided an image forming apparatus comprising a body provided with a conveyance path in which a sheet is conveyed; a feed tray which is detachably attached to an upstream position of the body with respect to a sheet conveyance direction; a roller which is provided in the feed tray, the roller conveying the sheet into the conveyance path from the feed tray; and a guide member which is provided in the feed tray, the guide member guiding the sheet from the roller to the conveyance path while sliding the sheet in a position on a downstream side of the roller with respect to the sheet conveyance direction.

According to another exemplary embodiment of the present invention, there is provided an image forming apparatus comprising a chute which is provided in a middle of a conveyance path for conveying a sheet and which is formed so that a width of the chute crossing a sheet conveyance direction is tapered in a downstream side with respect to the sheet conveyance direction; and a roller which is provided at a most downstream side of the chute with respect to the sheet conveyance direction so that the roller conveys the sheet from the chute to the conveyance path.

According to yet another exemplary embodiment of the present invention, there is provided an image forming apparatus comprising a body comprising a conveyance path into which a sheet is conveyed; and a feed tray. The feed tray comprises a separation pad, which is provided at a widthwise center of the feed tray; and a holding member, which is provided downstream of the separation pad in a direction of conveyance of the sheet, the holding member comprising a driven roller, which is wider than the separation pad, and at least two guide members, one guide member arranged on each side of the driven roller.

BRIEF DESCRIPTION OF THE DRAWINGS

Illustrative aspects of the present invention will be described in detail with reference to the following figures wherein.

DETAILED DESCRIPTION OF EXEMPLARY EMBODIMENTS OF THE PRESENT INVENTION

Figure 1:
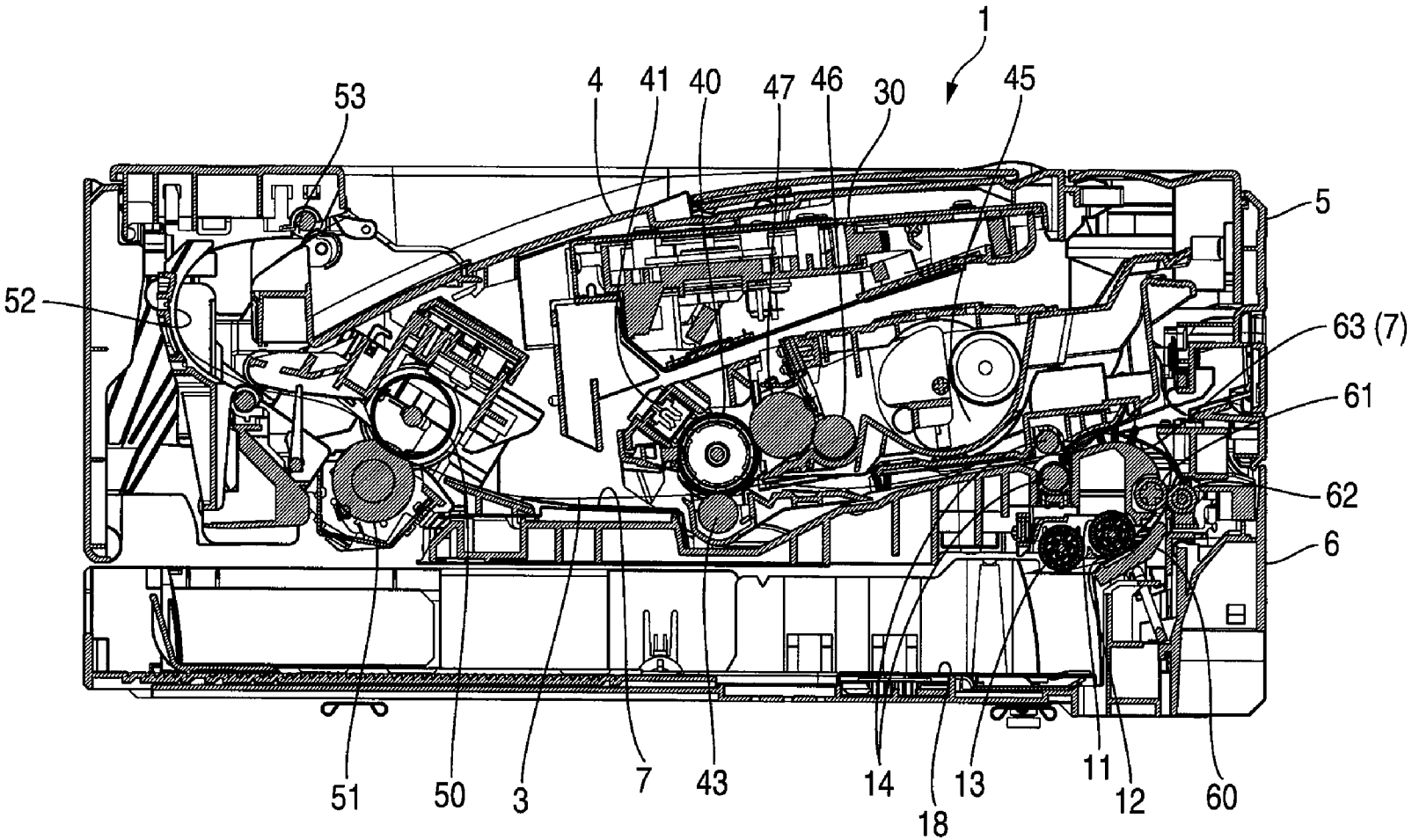
FIG. 1 is a longitudinal sectional view of an image forming apparatus according to an exemplary embodiment of the present invention.

Exemplary embodiments of the present invention will now be described with reference to FIG. 1 to FIG. 12. FIG. 1 is a side sectional view of an image forming apparatus according to an exemplary embodiment of the present invention. In this exemplary embodiment, the image forming apparatus is embodied in the form of a laser printer 1, and a recording medium is embodied in the form of a paper 3. In the following description, the right side and the left side in FIG. 1 are regarded as "front side" and "rear side" respectively.

(Overall Structure)

The laser printer 1 has a main body 5 provided with a conveyance path 7 on which sheets 3 are conveyed. A feed tray 6, on which sheets 3 which have not been printed yet (before image formation) are received, is provided in a lower portion of a front wall of the main body 5 so that the feed tray 6 can be pulled out (detachably) from the front side. A sheet discharging tray 4 is provided in an upper surface of the main body 5 so that sheets 3 that have been printed (after image formation) are discharged to the sheet discharging tray 4.

One or more of the sheets 3 are stacked on and received in the feed try 6. The sheets 3 are pressed toward a feed roller 13 by a pressing plate 18. The sheets 3 are conveyed to a separation roller 11 by rotation of the feed roller 13. The sheets 3 are separated page by page when held between the separating roller 11 and a separation pad 12.

The sheet 3 is guided to a first chute 60 and conveyed between a driving roller 61 provided in the main body 5 and a driven roller 62 provided in the feed tray 6.

The sheet 3 is conveyed to a pair of registration rollers 14 while guided to a second chute 63 by the driving roller 61 and the driven roller 62. The second chute is a part of the conveyance path 7. The registration rollers 14 correct skewing of the sheet 3 and then feed the sheet 3 between a photoconductive drum 40 and a transfer roller 43.

First, the surface of the photoconductive drum 40 is electro-statically charged to be positive uniformly by a scorotron type charger 41 in accordance with rotation of the photoconductive drum 40. Then, the surface of the photoconductive drum 40 is exposed to laser light emitted from a scanner unit 30. Thus, an electrostatic latent image corresponding to an image which should be formed on the sheet 3 is formed on the surface of the photoconductive drum 40.

Toner (not shown) contained in a toner containing chamber 45 is electro-statically charged to be positive by friction between a feed roller 46 and a developing roller 47. Then, toner on the developing roller 47 is supplied onto the surface of the photoconductive drum 40 by rotation of the developing roller 47. Then, the toner is carried on the electrostatic latent image so that the electrostatic latent image is visualized to thereby form a toner image. While the sheet 3 passes between the photoconductive drum 40 and the transfer roller 43, the toner image carried on the surface of the photoconductive drum 40 is transferred onto the sheet 3 by a transfer bias voltage applied to the transfer roller 43.

The sheet 3 with the toner image transferred thereto is conveyed between a heating roller 50 and a pressing roller 51. The sheet 3 is pressed against the heating roller 50 by the pressing roller 51. The toner deposited on the sheet 3 is heated by the heating roller 50 so as to be fixed on the sheet 3.

A sheet discharging path 52, which extends vertically toward an upper surface of the main body 5, is provided on a downstream side of the heating roller 50 and the pressing roller 51. The sheet 3 conveyed to the sheet discharging path 52 is discharged onto the sheet discharging tray 4 by a discharge roller 53 provided above the sheet discharging path 52.

(Feed Tray)

Figure 2:
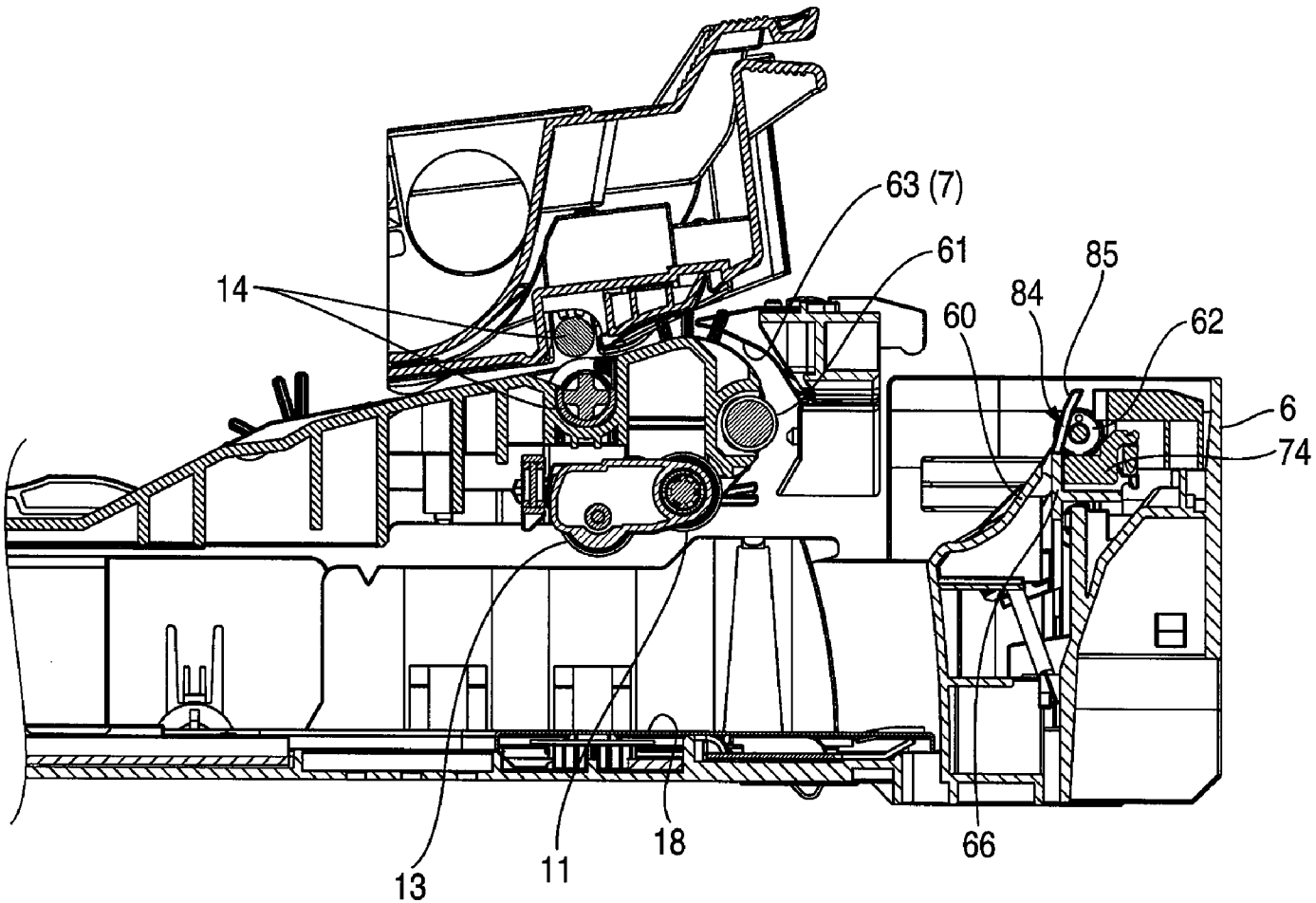
FIG. 2 is an enlarged sectional view of the image forming apparatus of FIG. 1 showing a state in which a feed tray has been pulled out of a main body of the image forming apparatus.
Figure 3:
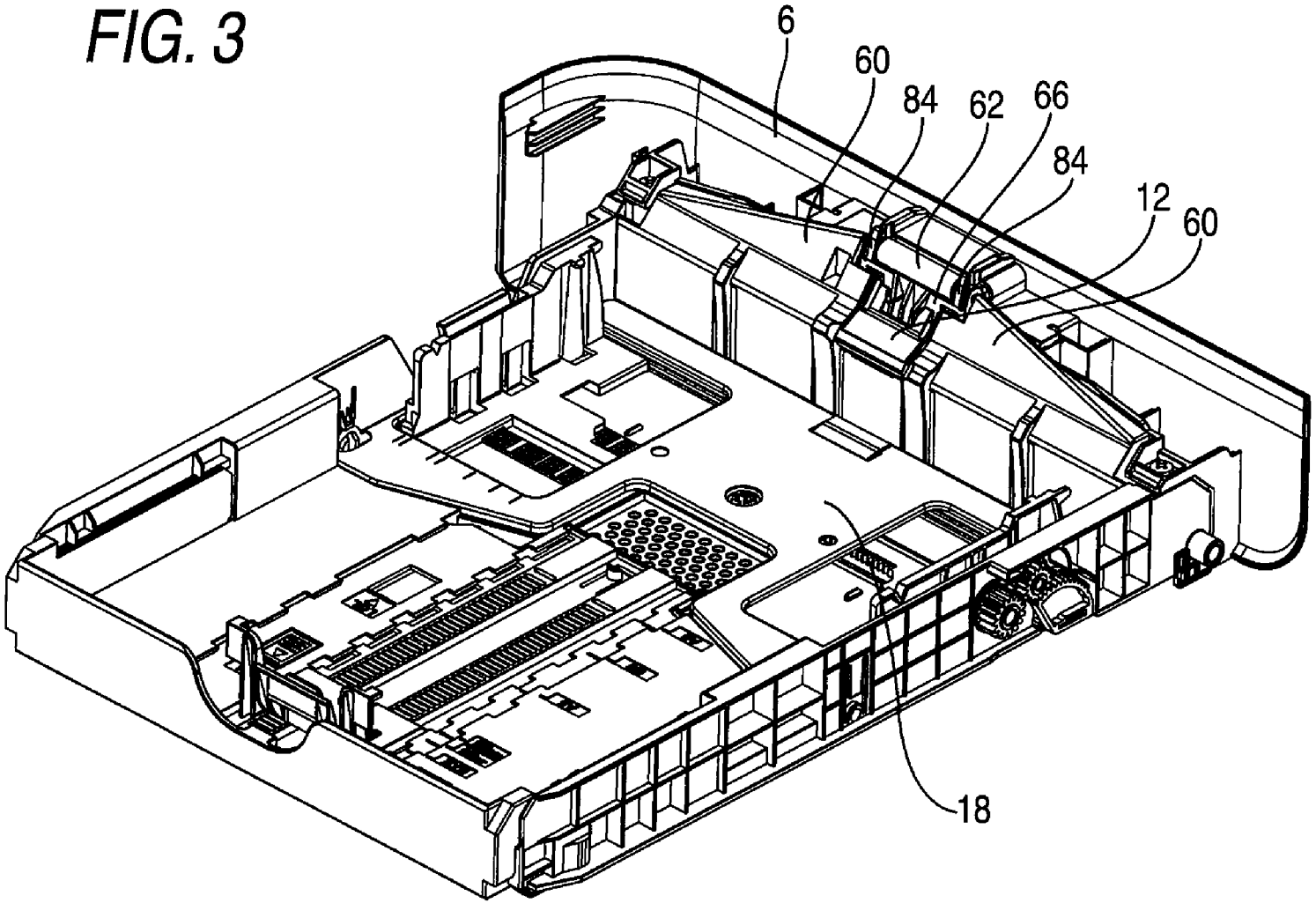
FIG. 3 is an overall perspective view of a feed tray of the image forming apparatus of FIG. 1.
Figure 4:
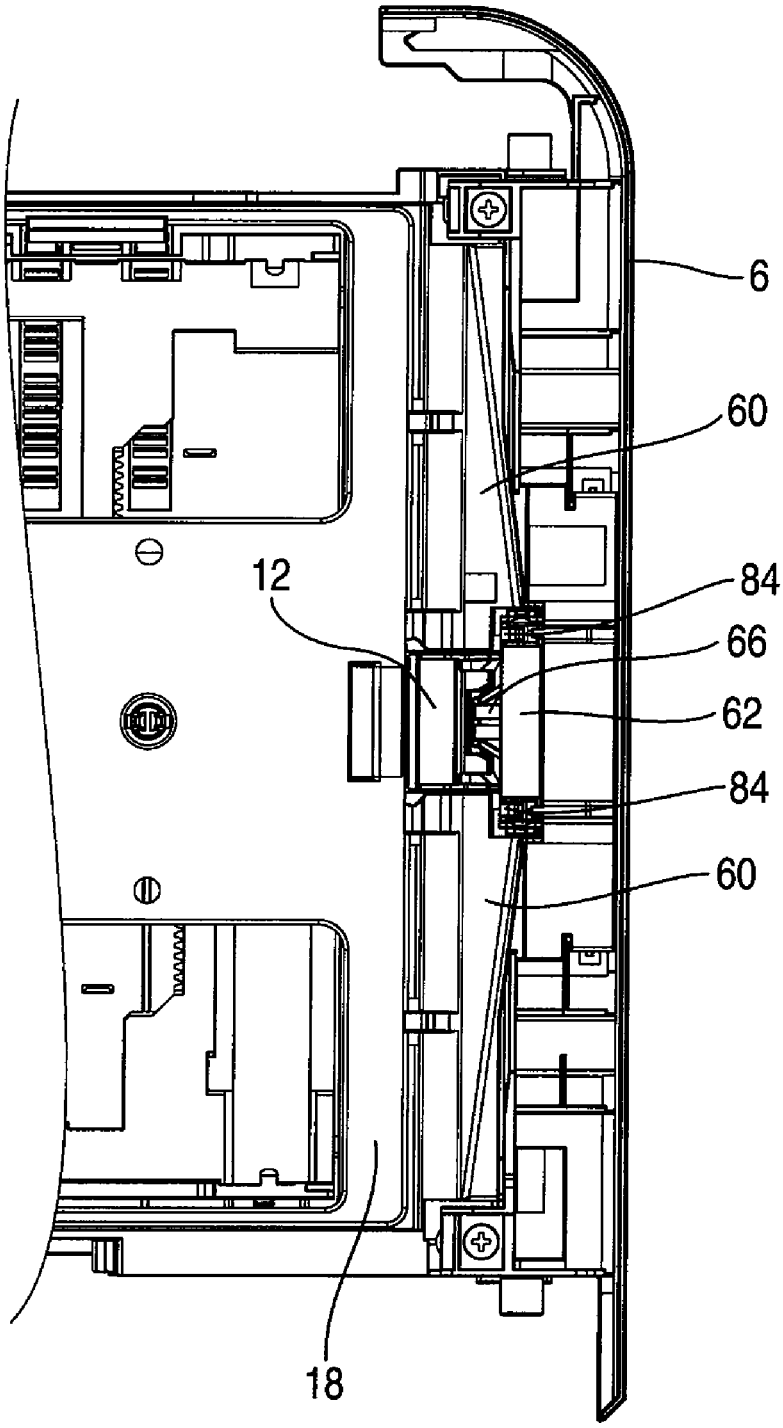
FIG. 4 is an enlarged plan view of the feed tray of FIG. 3.

As shown in FIG. 3, the feed tray 6 has a box shape having an open upper surface. The separation pad 12 is provided in a wall of the feed tray 6 on a downstream side (right side in FIG. 2) with respect to a sheet conveyance direction. As shown in FIGS. 3 to 6, the separation pad 12 is made of an elastic member such as urethane rubber and substantially shaped like a rectangle. The width of the separation pad 12 in a widthwise direction perpendicular to the sheet conveyance direction (hereinafter referred to as widthwise direction) is formed to be smaller than the width of the sheet 3. As shown in FIG. 4, the separation pad 12 is disposed near the center of the feed tray 6 in the widthwise direction (vertical direction in FIG. 4). The separation pad 12 is formed so as to come into contact with each sheet 3 in substantially the center of the feed tray 6 in the widthwise direction.

(First Chute)

Figure 5:
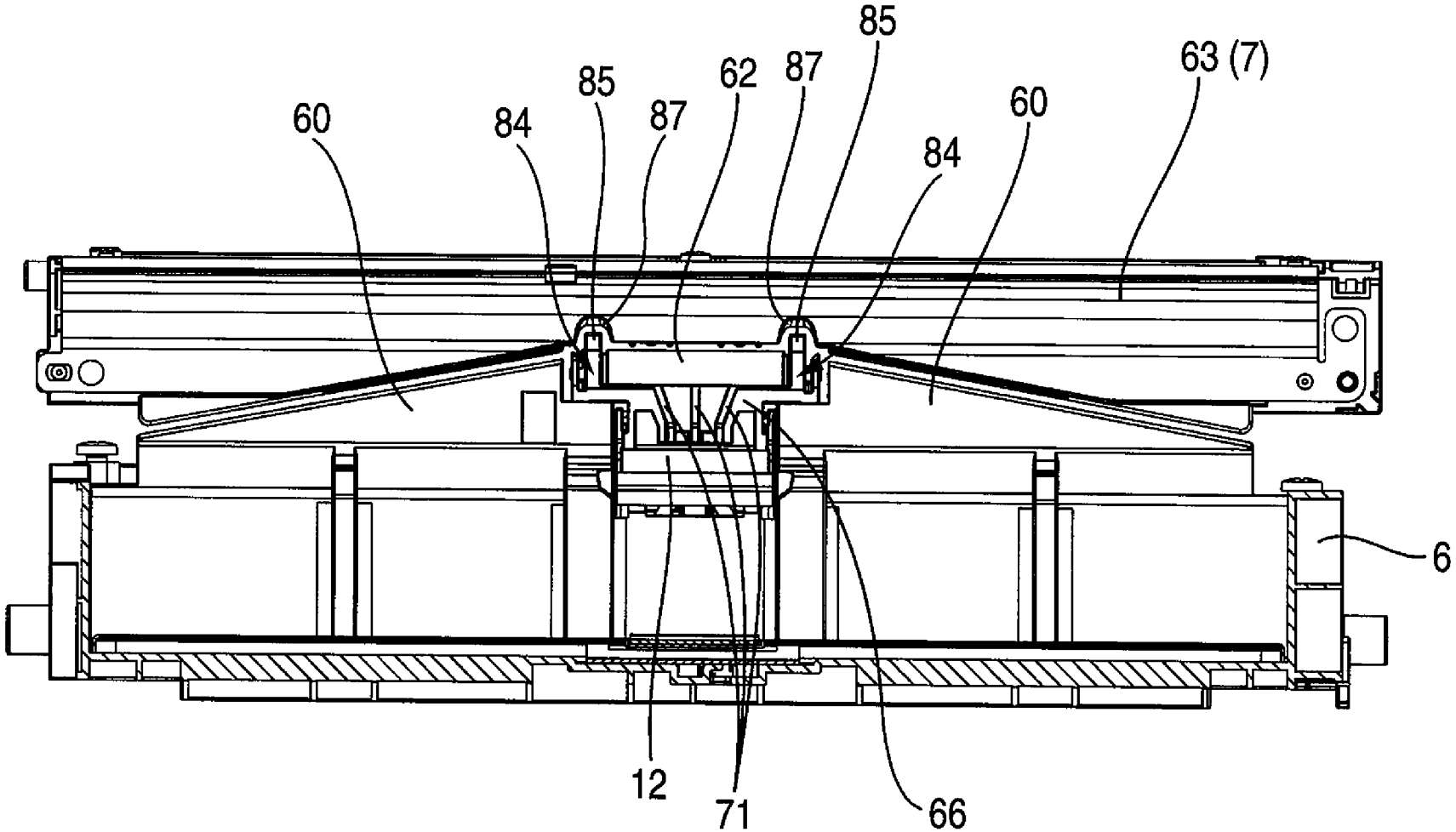
FIG. 5 is an enlarged view of the feed tray of FIG. 4 showing a positional relation between the feed tray and a second chute.

As shown in FIGS. 2 to 6, the first chute 60 is provided on a downstream side of the separation pad 12. As shown in FIG. 5, the first chute 60 is formed so that the width of the first chute 60 in the widthwise direction (lateral direction in FIG. 5) is tapered gradually toward the downstream side (upper side in FIG. 5) with respect to the direction of conveyance of the sheet 3. As shown in FIG. 2, the first chute 60 is inclined upward on the downstream side (right side in FIG. 2) with respect to the sheet conveyance direction (see FIG. 2). The first chute 60 is formed so as to be symmetric with respect to the widthwise direction (i.e., the lateral direction in FIG. 5), which is perpendicular to the sheet conveyance direction. In other words, the first chute 60 is substantially shaped like a mountain.

(Driven Roller)

The driven roller 62 is disposed in a position at most downstream end of the first chute in the sheet conveyance direction. The driven roller 62 comes into contact with the driving roller 61, which will be described later, so that the driven roller 62 is driven to rotate in accordance with rotation of the driving roller 61. The driven roller 62 is disposed in a holding member 66 made of synthetic resin. The holding member 66 is disposed in the feed tray 6.

As shown in FIG. 4, the driven roller 62 is disposed near the center of the first chute 60 in the widthwise direction (vertical direction in FIG. 4). Thus, the driven roller 62 is disposed in a position on the downstream side of the separation pad 12 with respective to the sheet conveyance direction (see FIG. 3). Thus, when the sheet 3 has been conveyed to the driven roller 62 from the separation roller 11 and the separation pad 12, the driven roller 62 comes into contact with a region of the sheet 3 which has been in contact with the separation pad 12. The width of the driven roller 62 in the widthwise direction is set to be slightly larger than the width of the separation pad 12 (see FIG. 3).

The aforementioned driven roller 62 is a resin roller, such as a roller made of a fluorocarbon polymer, a fluorocarbon-coated roller, etc., having a surface capable of being easily charged with electricity. The driven roller 62 is disposed on a second shaft 65 made of metal.

(Holding Member)

Figure 7:
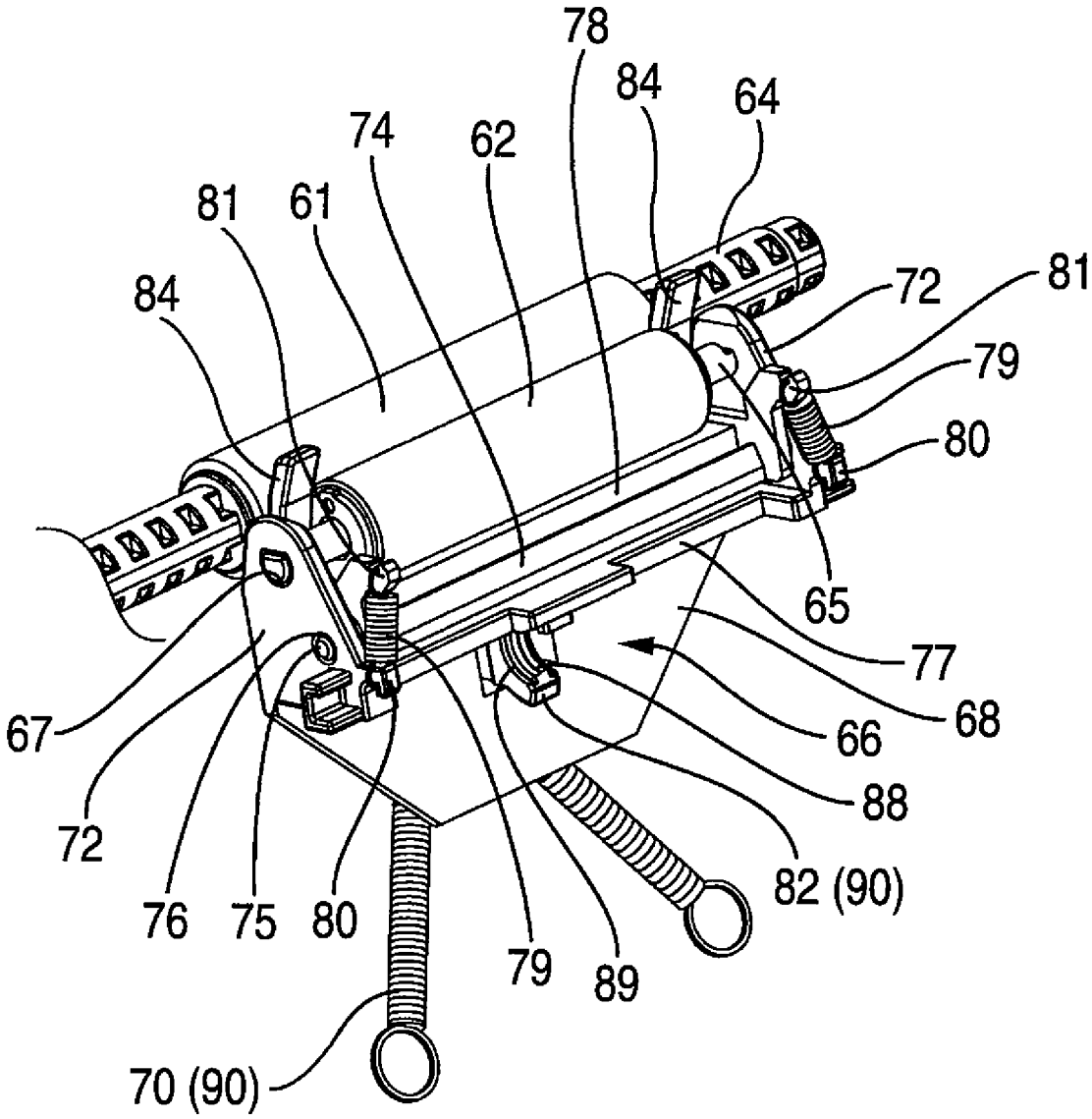
FIG. 7 is an enlarged perspective view showing a driving roller, a driven roller and a holding member of the feed tray of FIG. 4.
Figure 8:
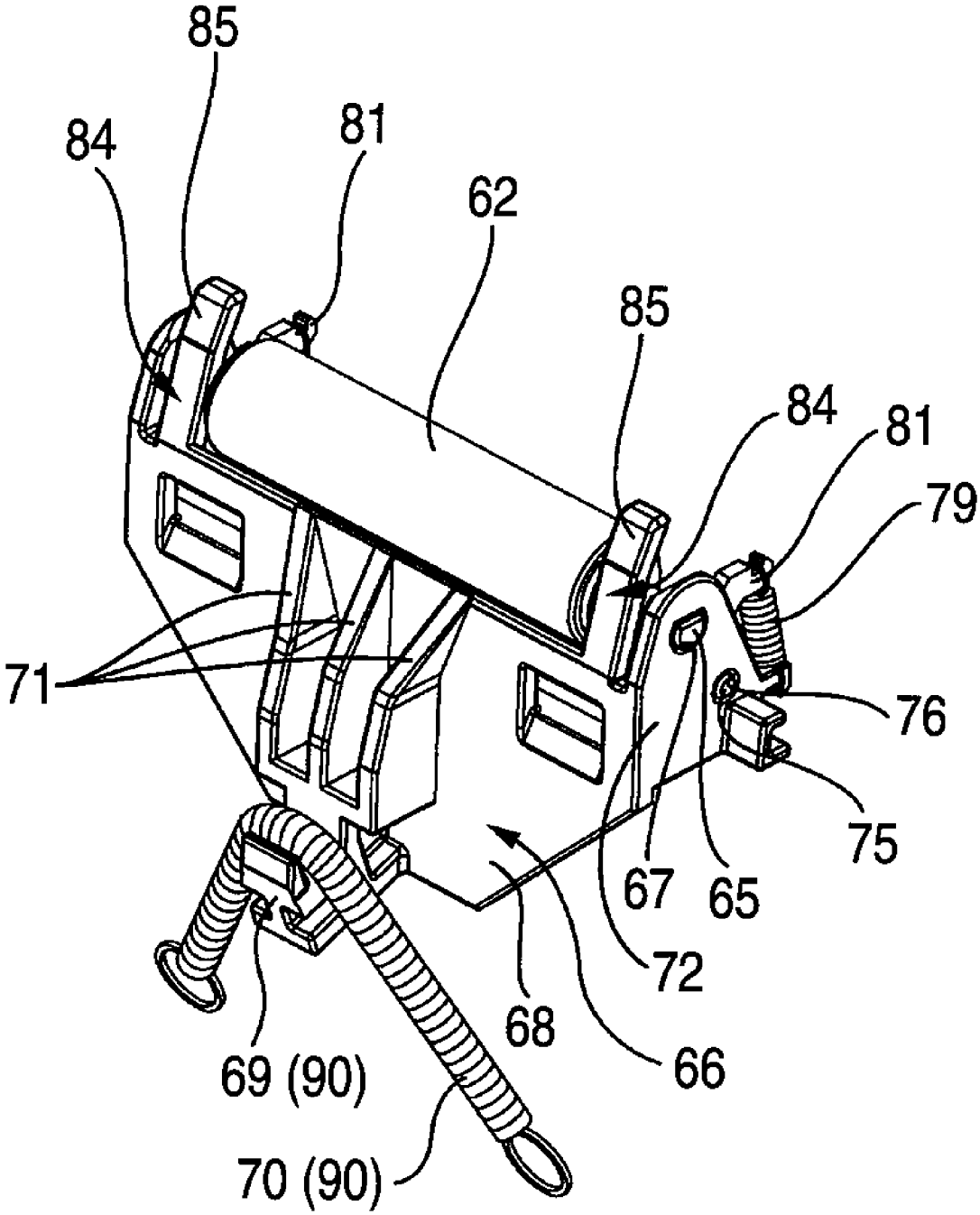
FIG. 8 is an enlarged perspective view as viewed from a position different from FIG. 7.
Figure 9:
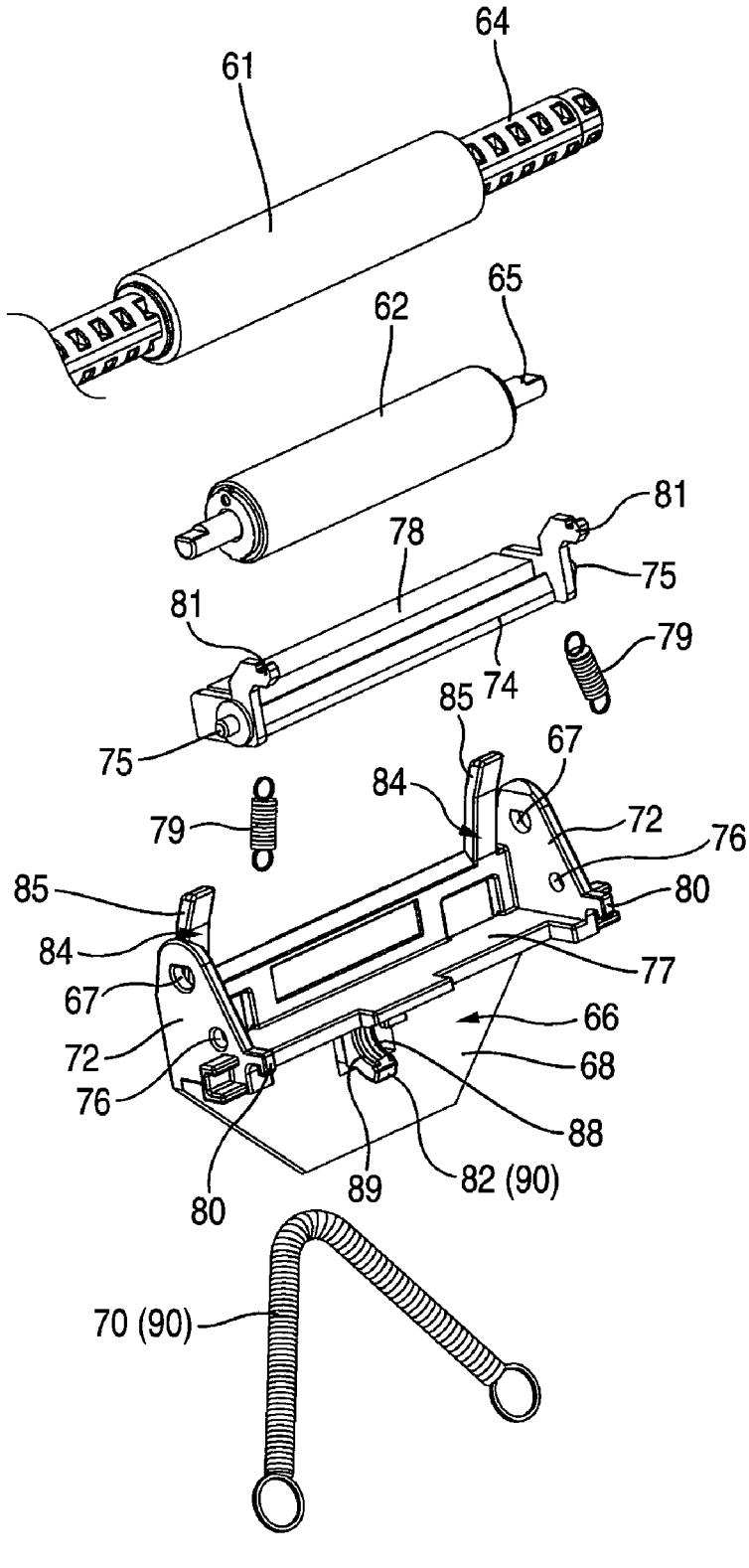
FIG. 9 is an exploded perspective view of the driving roller, the driven roller, and the holding member of FIG. 7.

As shown in FIGS. 7 to 9, the holding member 66 has a plate-like body portion 68. The body portion 68 is disposed in such a posture that the plate-like body portion 68 faces the conveyance path 7. As shown in FIG. 8, three ribs 71 extending vertically are formed near the widthwise center of a surface of the body portion 68 facing the conveyance path 7 so as to protrude toward the conveyance path 7. Each of the ribs 71 has an upper portion which is inclined leading to the driven roller 62. The sheet 3 is guided to the driven roller 62 by the ribs 71.

As shown in FIG. 9, two of side walls 72 extending to the rear side of the body portion 68 are formed at opposite widthwise end portions of the body portion 68. First through holes 67 for inserting the second shaft 65 of the driven roller 62 therein are formed near upper end portions of the side walls 72 respectively so that the side walls 72 are penetrated in the widthwise direction The second shaft 65 of the driven roller 62 is inserted in the first through holes 67.

Figure 12:
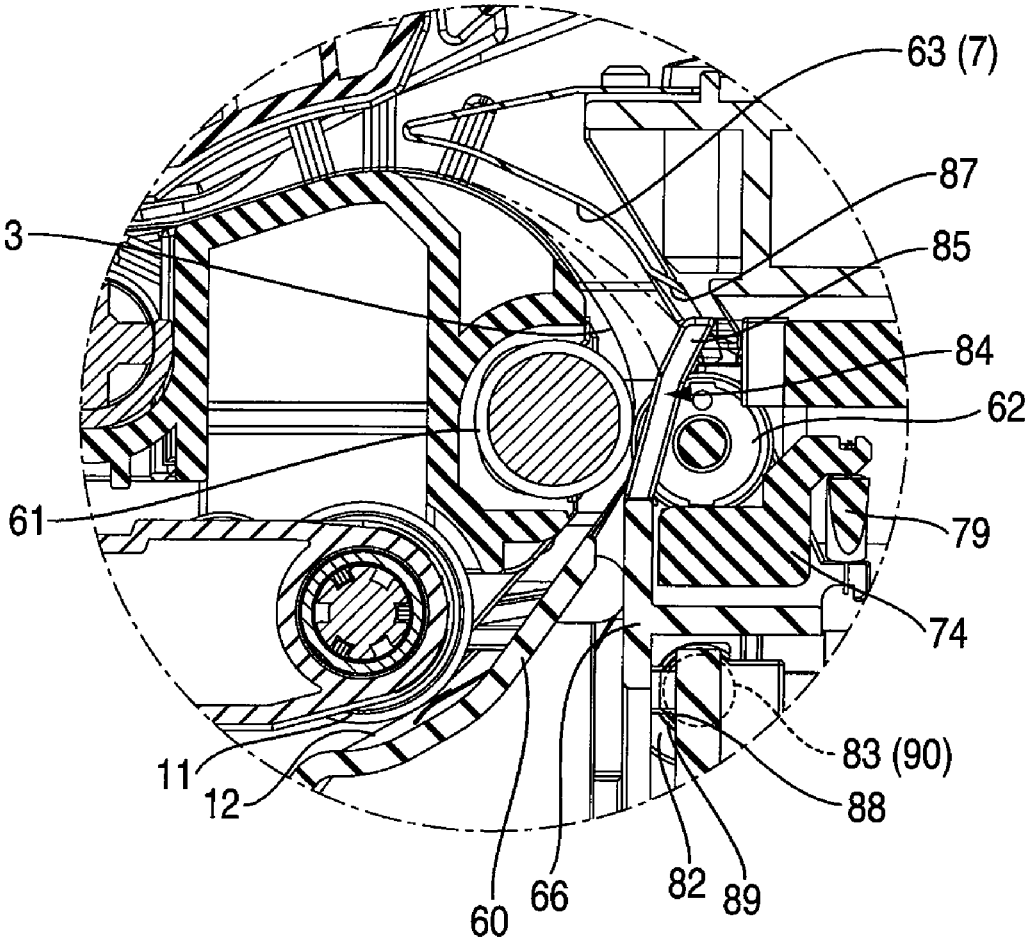
FIG. 12 is an enlarged sectional view of the image forming apparatus of FIG. 1 showing a positional relation between the guide member and a sheet.

As shown in FIG. 9, a hook-like bearing 82 is formed near substantially the widthwise center of the front surface of the body portion 68 so as to protrude frontward. An inner portion of the bearing 82 is a part of an arc. As shown in FIG. 12, a fourth shaft 83 provided in the feed tray 6 is inserted in the bearing 82. Returning to FIG. 9, a large diameter portion 89 having an inner diameter larger than the outer diameter of the fourth shaft 83, and a small diameter portion 88 having an inner diameter set to be substantially equal to or slightly larger than the outer diameter of the fourth shaft 83 are provided in the inner portion of the bearing 82.

Moreover, as shown in FIG. 8, a first hook 69 is formed in a lower end portion of the surface of the body portion 68 facing to the conveyance path 7. A portion near the lengthwise center of a first spring 70 engages the first hook 69. Opposite end portions of the first spring 70 are fixed to the feed tray 6 by a known method such as a method of being engaged in hooks (not shown). The first spring 70 urges the driven roller 62 to approach the driving roller 61.

As described above, the holding member 66 is attached to the feed tray 6 using the first spring 70 and the fourth shaft 83. The driven roller 62 retained by the holding member 66 is disposed so that the driven roller 62 can be swung in a direction opposite to the driving roller 61 and a direction tangential to the driving roller 61 in a position opposite to the driving roller 61 relative to the feed tray 6, by the first spring 70, the first hook 69, the bearing 82 and the fourth shaft 83.

(Sponge Support Member)

As shown in FIGS. 7 to 9, a sponge support member 74 to which a sponge member 78 is attached is disposed in the holding member 66. As shown in FIG. 9, the sponge support member 74 is made of synthetic resin and shaped like a plate extending in the widthwise direction. The sponge member 78 is bonded to an upper surface of the sponge support member 74. The sponge member 78 is made of a material such as urethane foam capable of charging the driven roller 62 with electricity easily.

A pair (i.e., two) of third hooks 81 protruding frontward for hooking second springs 79 are formed in opposite widthwise end portions of the sponge support member 74.

A pair of second hooks 80 for hooking the second springs 79 are formed in front end portions of the side walls 72 of the holding member 66. While one end of each of the second springs 79 engages a corresponding one of the second hooks 80, the other end of each of the second springs 79 engages a corresponding one of the aforementioned third hooks 81.

A pair of third shafts 75 protruding outward from the sponge support member 74 in the widthwise direction are provided in the opposite widthwise end portions of the sponge support member 74.

Second through holes 76 for inserting the third shafts 75 therein are formed near lower end portions of the side walls 72 of the holding member 66. The third shafts 75 are rotatably inserted in the second through holes 76 provided in the side walls 72 of the holding member 66.

A support wall 77 which can support the sponge support member 74 from below is provided in the front surface (right front side surface in FIG. 9) of the body portion 68 of the holding member 66 so as to extend frontward. The support wall 77 can receive the sponge support member 74 from below, for example, before the second springs 79 are engaged with the second and third hooks 80 and 81, or when the second springs 79 have dropped out of the second and third hooks 80 and 81.

According to the above-described configuration, the sponge support member 74 is attached to the holding member 66 so that the second springs 79 urge the sponge member 78 upward with the third shafts 75 as an axis of rotation. The sponge member 78 urged upward comes into pressure contact with the driven roller 62. When the driven roller 62 rotates in a state in which the sponge member 78 is in pressure-contact with the driven roller 62, dusts deposited on each sheet 3 can be removed by the sponge member 78.

(Guide Member)

As shown in FIGS. 8 and 9, two guide members 84 each shaped like a rib and protruding toward the upper side (downstream side with respect to the sheet conveying direction) are provided in upper end portions of the body portion 68 of the holding member 66 in positions near the opposite widthwise end portions of the body portion 68 and slightly inward in the widthwise direction than the side walls 72. The height of each guide member 84 is set to be higher than the driven roller 62 in the condition that the driven roller 62 is attached to the holding member 66.

Figure 10:
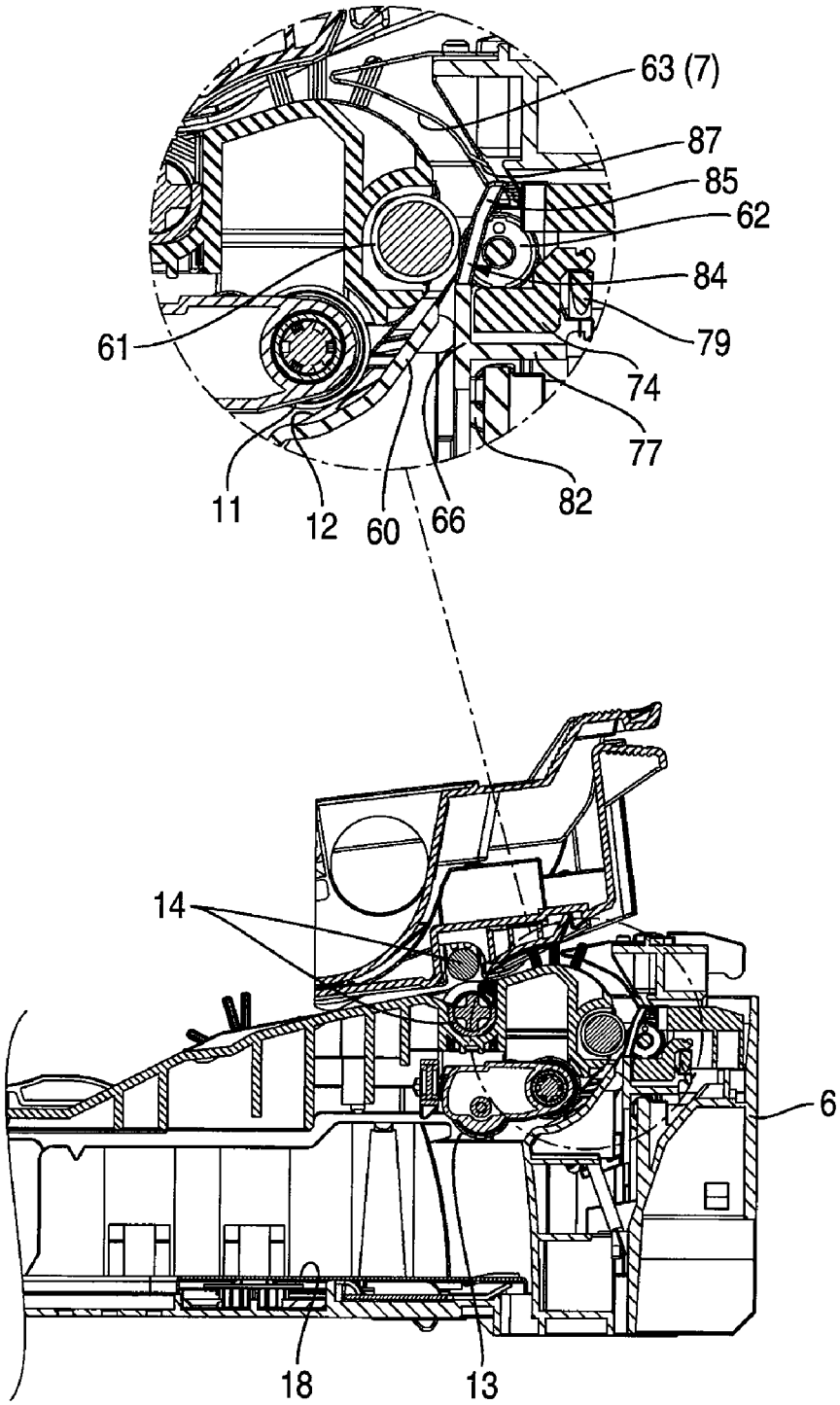
FIG. 10 is an enlarged sectional view of the image forming apparatus of FIG. 1 showing a positional relation between the driven roller and a guide member.

As shown in FIG. 10, each guide member 84 is provided so as to slope up toward the front (right in FIG. 10). A portion near an upper end of the guide member 84 is set as a sloped portion 85 which slopes more than the remaining portion of the guide member 84. In this exemplary embodiment, the sloped portion 85 is located on the downstream side of the driven roller 62 with respect to the sheet conveyance direction.

As shown in FIG. 12, the driven roller 62 protrudes from the guide members 84 toward the inside of the conveyance path 7 in a region of the guide members 84 lower than the sloped portions 85. Thus, each sheet 3 can be held between the driven roller 62 and the driving roller 61.

In the condition that the driven roller 62 is attached to the holding member 66, the guide members 84 are located at opposite ends of the second shaft 65 of the driven roller 62 in a rotary shaft direction (widthwise direction) so as to perform positioning the second shaft 65 of the driven roller 62.

(Driving Roller)

As shown in FIG. 10, the driving roller 61 is provided in the main body 5 of the image forming apparatus 1 so as to be located in a position corresponding to the driven roller 62 in the condition that the feed tray 6 is attached to the main body 5. The driving roller 61 is driven to rotate by a motor (not shown) disposed in the main body 5. As shown in FIGS. 7 and 9, the driving roller 61 is formed as a roller of rubber disposed on a first shaft 64 of metal. The driving roller 61 is attached to the main body 5 in the condition that the first shaft 64 is positionally fixed to the main body 5. Thus, each sheet 3 is conveyed while held between the driving roller 61 and the driven roller 62.

(Second Chute)

Figure 6:
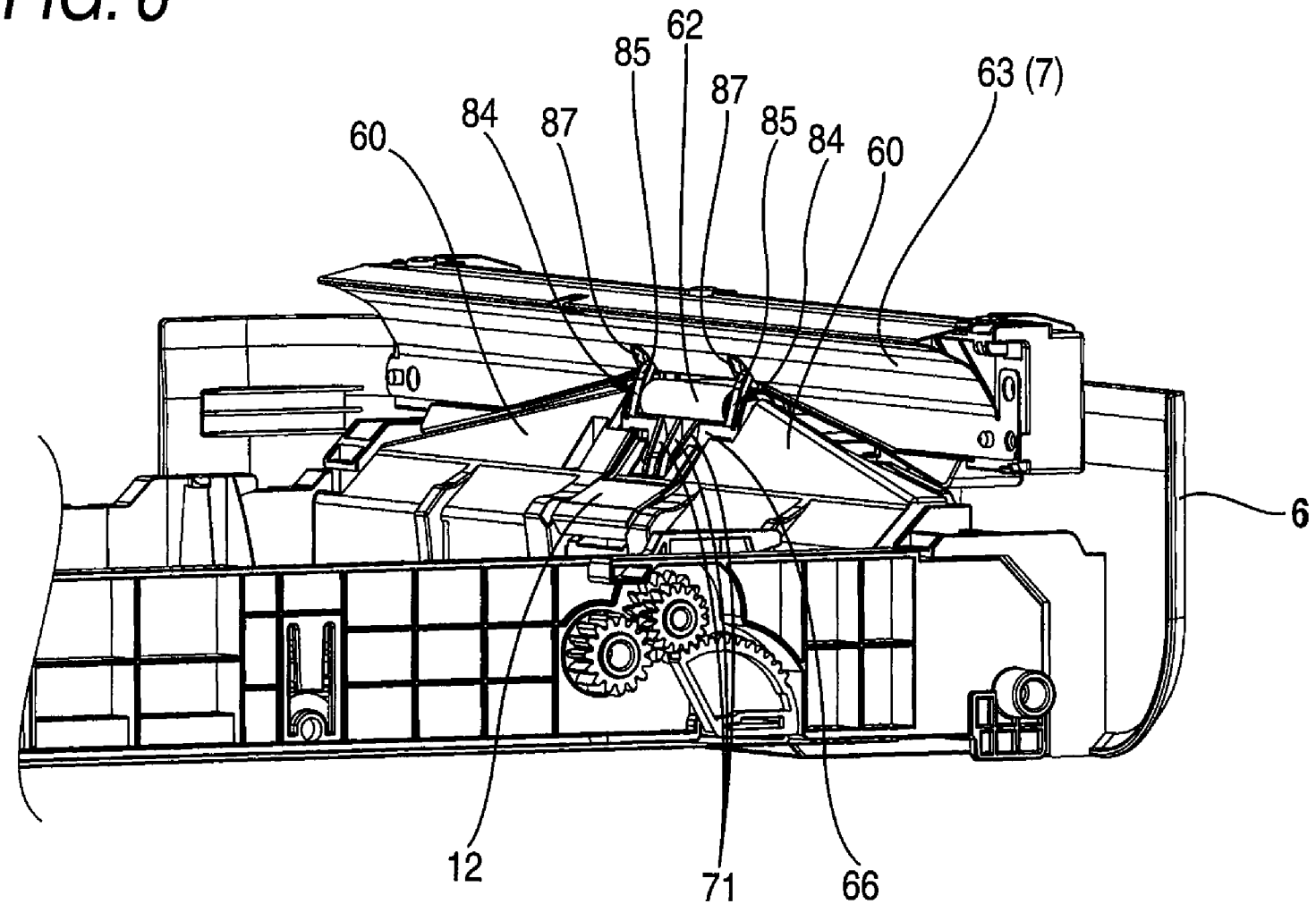
FIG. 6 is an enlarged perspective view of the feed tray of FIG. 4 showing the positional relation between the feed tray and the second chute.

As shown in FIGS. 5 and 6, a second chute 63 is provided in the main body 5 on the downstream side of the first chute 60 with respect to the sheet conveyance direction. As shown in FIG. 1, the second chute 63 is a part of the conveyance path 7. The second chute 63 is located on the most upstream side of the conveyance path 7 of the sheet 3 in the main body 5 (i.e., the most downstream side of the conveyance path 7 in the feed tray 6).

As shown in FIG. 5, a lower end portion on the upstream side with respect to the sheet conveyance direction of the second chute 63 is formed following the shape of an upper end portion on the downstream side with respect to the sheet conveyance direction of the first chute 60.

As shown in FIG. 6, recess portions 87 are formed in the second chute 63 so as to be located in positions corresponding to the guide members 84 respectively. An upper end of each of the guide members 84 is received in corresponding one of the recess portions 87.

As shown in FIG. 12, the sloped portion 85 of each of the guide members 84 is disposed to protrude inward from a track in which the trailing end (i.e., an end portion on the upstream side with respect to the sheet conveyance direction) of the sheet 3 is shifted to the second chute 63, that is, to protrude toward the downstream side from the track with respect to the sheet conveyance direction when the sheet 3 goes out from between the driving roller 61 and the driven roller 62.

Next, functions and effects of the exemplary embodiment described above will be described.

Figure 11:
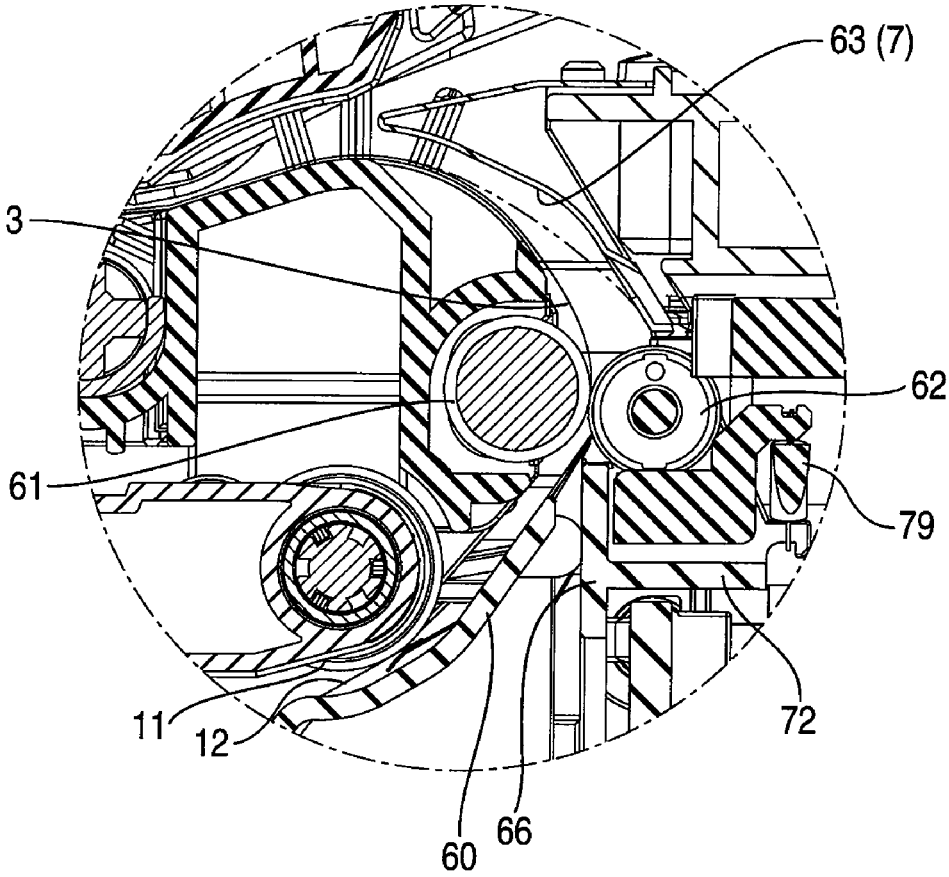
FIG. 11 is an enlarged sectional view of a related art image forming apparatus showing a configuration in which collision noise occurs.

FIG. 11 is an enlarged view showing a related art laser printer. A second chute 63 is disposed in a position to be led into the outside (right in FIG. 11) of a conveyance path 7 relative to a contact portion between a driving roller 61 and a driven roller 62, so that a leading end (a front end portion with respect to the sheet conveyance direction) of the sheet 3 conveyed between the driving roller 61 and the driven roller 62 can be prevented from being disturbed by the second chute 63. Thus, a difference in level is formed between each of the driving and driven rollers 61 and 62 and the second chute 63. When a sheet 3 comes out from between the driving roller 61 and the driven roller 62, a trailing end of the sheet 3 is bounced up to the second chute 63 from the contact portion between the driving roller 61 and the driven roller 62 due to this level difference (i.e., the step portion). That is, the trailing end of the sheet 3 slaps against a wall of the second chute 63. Accordingly, there is a case that collision noise occurs because the trailing end of the sheet 3 collides with the second chute 63 as designated by a chain double-dashed line in FIG. 11.

In addition, the driven roller 62 is disposed in the feed tray 6 whereas the driving roller 61 and the second chute 63 are disposed in the main body 5. The difference in level between each of the driving and driven rollers 61 and 62 and the second chute 63 is relatively large, because the feed tray 6 may be shifted from a regular attachment position. Therefore, collision noise of the sheet 3 is apt to occur and may be magnified.

By contrast, in the exemplary embodiment, the guide members 84 for guiding each sheet 3 to the second chute 63 from the driving roller 61 and the driven roller 62 while sliding on the sheet 3 in a position on the downstream side of the driving and driven rollers 61 and 62 with respect to the sheet conveyance direction are provided in the feed tray 6.

As shown in FIG. 12, a trailing end of the sheet 3 (solid line in FIG. 12) slides on the left side surfaces of the guide members 84 in FIG. 12 after coming out from between the driving roller 61 and the driven roller 62. When the sheet 3 is conveyed to the downstream side, the trailing end of the sheet 3 moves up to reach the sloped portions 85 (see the chain line in FIG. 12) while sliding on the left side surfaces of the guide members 84. The sheet 3 moves up while sliding along the sloped portions 85, so that the sheet 3 moves to the second chute 63 from upper ends of the sloped portions 85. Thus, the sheet 3 moves to the second chute 63 from the guide members 84 without bouncing up or slapping against the second chute 63 (see the chain double-dashed line in FIG. 12). Thus, collision noise of the sheet 3 can be prevented from occurring.

Each of the guide members 84 is shaped like a rib extending in the sheet conveyance direction. Recess portions 87 for receiving the guide members 84 respectively are formed in the second chute 63 so as to be located in positions corresponding to the guide members 84. Accordingly, the upper ends of the guide members 84 (downstream ends in the conveyance direction) are received in the recess portions 87 of the second chute 63. The sheet 3 can be conveyed to the second chute 63 from the guide members 84 without being disturbed.

Further, the guide members 84 are formed to protrude inward from a track in which the trailing end of the sheet 3 is shifted to the second chute 63 from the driven roller 62, that is, to protrude toward the downstream side of the track with respect to the conveyance direction when the trailing end of the sheet 3 comes out from the driven roller 62. Thus, since the trailing end of the sheet 3 coming out from the driven roller 62 comes into contact with the guide members 84 ahead of the second chute 63, the sheet 3 can be surely slid on the guide members 84. Thus, collision noise of the sheet 3 can be more greatly prevented from being caused by collision of the sheet 3 with the second chute 63.

In the related art image forming apparatus, the conveyance path 7 may be curved. In such a case, the sheet 3 is curved following the conveyance path 7 and suffers a pressing force from the conveyance path 7 when the sheet 3 is conveyed along the conveyance path 7. Then, an elastic force acts on the sheet 3 to restore the sheet 3 to the original shape. In the case where the elastic force is large, there is a possibility that collision noise may become large because the bounced sheet 3 strikes against the conveyance path extensively.

By contrast, in the exemplary embodiment described above, the first chute 60 for guiding each sheet 3 to the driven roller 62 is provided in the feed tray 6 so as to be located in a position on the upstream side of the driven roller 62 with respect to the sheet conveyance direction. The first chute 60 is provided so that the width of the first chute 60 perpendicular to the sheet conveyance direction is tapered toward the downstream side with respect to the sheet conveyance direction.

Accordingly, as the sheet 3 is conveyed on the first chute 60 toward the downstream side with respect to the conveyance direction, the sheet 3 is gradually protruded from outer edges of the first chute 60 in end portions where the width of the first chute 60 is formed to be narrow. Then, since the sheet 3 protruded from the first chute 60 does not suffer pressing force from the first chute 60, the elastic force of the sheet 3 is released gradually. Thus, it is possible to prevent collision noise.

In addition, the first chute 60 is formed symmetrically with respect to the widthwise direction perpendicular to the sheet conveyance direction. Thus, the sheet 3 protrudes from the end edges of the first chute 60 gradually on the opposite end portion sides in the widthwise direction perpendicular to the conveyance direction. Thus, it is possible to prevent the sheet 3 from skewing.

Further, the lower end of the second chute 63 (i.e., an upstream end with respect to the sheet conveyance direction) is formed in accordance with the shape of a downstream end of the first chute 60. Thus, the sheet 3 is conveyed without being disturbed by a joint portion between the first chute 60 and the second chute 63. The aforementioned configuration is more effective in the case where the first chute 60 is provided in the feed tray 6 and the second chute 63 is provided in the main body 5.

In the case where, for example, a roller is provided in a position on an upstream side from a downstream-side end portion of the first chute 60 with respect to the sheet conveyance direction, a difference in level may be created between the first chute 60 and the roller. Accordingly, collision noise may be caused by collision of the sheet 3 with the first chute 60 because the sheet 3 coming out from the roller bounces up and slaps against the first chute 60 due to this level difference.

By contrast, in the exemplary embodiment described above, the driven roller 62 for conveying each sheet 3 from the first chute 60 to the second chute 63 is provided on the most downstream side of the first chute 60 with respect to the sheet conveyance direction.

Accordingly, there is no level difference formed between the driven roller 62 and the first chute 60 on the downstream side of the driven roller 62. Thus, collision noise can be prevented from being caused by collision of the sheet 3 with the first chute 60 after the sheet 3 passes through the driven roller 62.

Moreover, the feed tray 6 is detachably attached to the main body 5. The feed tray 6 may be attached to the main body 5 in such a posture that the feed tray 6 is shifted from a regular position. Then, the positional relation between the driving roller 61 having the first shaft 64 positionally fixed to the main body 5 and each guide member 84 attached to the feed tray 6 may be shifted from the regular position. Accordingly, in the exemplary embodiment described above, the guide members 84 are provided in the holding member 66 provided with the support mechanism 90 for keeping the second shaft 65 of the driven roller 62 substantially in parallel to the first shaft 64 of the driving roller 61. Thus, the guide members can be positioned relative to the driving roller with high accuracy.

In addition, the guide members 84 perform positioning of the rotary shaft direction (i.e., a widthwise direction) of the driven roller 62. Accordingly, the guide members 84 can also serve as members for positioning the driven roller 62, so that it is possible to reduce the number of parts in the image forming apparatus.

In the related art image forming apparatus, the sheet 3 pressed against the separation pad 12 by the separation roller 11 comes into frictional contact with the separation pad 12. Then, paper powder is generated in a region where the sheet 3 and the separation pad 12 come into frictional contact with each other. When the sheet 3 with the paper powder deposited thereon arrives at the photosensitive drum 40, there is a fear that lowering of image quality may be caused by the paper powder mixed with toner.

By contrast, in the exemplary embodiment, the driven roller 62 can remove foreign matter deposited on the surface of the sheet 3. Thus, the driven roller 62 can also serve as a so-called paper powder removal roller, so that it is possible to reduce the number of parts.

Other Exemplary Embodiments

The present invention is not limited to the exemplary embodiment described above. For example, the following additional exemplary embodiments are also included in the technical scope of the invention.

The driven roller 62 may have a length to cover the whole width of the feed tray 6.

The number of the guide members 84 may be one, or three or more.

Each guide member 84 may be shaped like a plate.

The recess portions 87 may be arranged so that the recess portions 87 are not provided in positions corresponding to the guide members 84 in the second chute 63.

The first chute 60 need not be symmetrical with respect to the widthwise direction perpendicular to the sheet conveyance direction. For example, a slope tapered toward the downstream side with respect to the sheet conveyance direction may be formed in one side edge of the first chute 60 in the widthwise direction.

The guide members 84 may be provided on the side of the sheet discharging path 52. In addition, the first chute 60 or the second chute 63 may be provided in the sheet discharging path 52.

According to exemplary embodiments of the present invention, since the sheet is guided to the conveyance path from the roller while sliding on the guide member, collision noise can be prevented from being caused by collision of the sheet with the conveyance path.

A driving roller driven to rotate by a drive source disposed in the main body may be provided in the main body in such a state that a rotary shaft of the driving roller is positionally fixed to the main body. A driven roller may be provided separately from the driving roller and comes into contact with the driving roller so that the driven roller is driven to rotate in accordance with a rotation of the driving roller when the feed tray is attached to the main body. The driven roller may be disposed in a retention member which retains the driven roller so that the driven roller can rotate. The retention member may have a support mechanism which swingably supports the retention member to the feed tray so that a rotary shaft of the driven roller and the rotary shaft of the driving roller are substantially parallel to each other while the driving roller and the driven roller come into contact with each other. The guide member may be provided in the retention member.

The feed tray is detachably attached to the body. Accordingly, the feed tray may be attached to the body in such a posture that the feed tray is shifted from a regular position. Then, the positional relation between the driving roller with its rotary shaft positionally fixed to the body and the guide member attached to the feed tray may be shifted from the regular position. According to this configuration, the guide member may be provided in the retention member provided with the support mechanism which keeps the rotary shaft of the driven roller substantially in parallel with the rotary shaft of the driving roller. Thus, the guide member can be positioned relative to the driving roller with high accuracy.

The guide member is shaped like a rib extending in the sheet conveyance direction, and the conveyance path has a recess portion which is formed in a position corresponding to the guide member so that the recess portion receives the guide member. Accordingly, a downstream portion of the guide member with respect to the sheet conveyance direction is received in the recess portion of the conveyance path in advance. Thus, the sheet can be conveyed to the conveyance path from the guide member without being disturbed.

The guide member is formed to protrude toward a downstream side of a track in which a trailing end of the sheet is shifted to the conveyance path from the roller with respect to the conveyance direction when the trailing end of the sheet goes out from the roller. Accordingly, since the trailing end of the sheet coming out from the roller comes into contact with the guide member ahead of the conveyance path, the sheet can be surely slid on the guide member. Incidentally, the term "trailing end of the sheet" denotes an end portion of the sheet located at the rear side with respect to the conveyance direction when the sheet is conveyed along the conveyance path. In other words, the term "trailing end of the sheet" denotes an end portion of the sheet located on the upstream side with respect to the conveyance direction.

The guide member performs positioning of a direction of the rotary shaft of the roller. Accordingly, since the guide member can also serve as a member for positioning the roller, it is possible to reduce the number of parts.

The roller can remove foreign matter deposited on a surface of the sheet. Thus, since the roller can serve also as a foreign matter removal roller, it is possible to reduce the number of parts.

The feed tray has a chute which is provided in a position on an upstream side of the roller with respect to the sheet conveyance direction so that the chute guides the sheet to the roller, and the chute is provided so that a width of the chute perpendicular to the conveyance direction is tampered toward the downstream side with respect to the sheet conveyance direction.

In the case where, for example, the chute is curved or the conveyance path on the downstream side of the chute is curved, the sheet suffers pressing force from the chute so as to be curved following the shape of the chute or the conveyance path as the sheet is conveyed on the chute. Then, elastic force acts on the sheet to restore the sheet to an original shape. When the elastic force is large, there is a possibility that collision noise may become large because the bounced sheet collides with the conveyance path intensively.

Accordingly, as the sheet is conveyed on the chute toward the downstream side with respect to the conveyance direction, the sheet is protruded gradually from outer edges of the chute in end portions of the chute formed to be narrow in width. Then, since the sheet protruded from the chute is prevented from suffering the pressure force from the chute, the elastic force of the sheet is released gradually. Thus, it is possible to prevent collision noise.

The chute is formed symmetrically with respect to a widthwise direction perpendicular to the sheet conveyance direction. Accordingly, the sheet protrudes from end edges of the chute gradually on opposite end portion sides in the widthwise direction perpendicular to the conveyance direction. Thus, it is possible to restrain the sheet from skewing.

An upstream end of the conveyance path is formed following a shape of a downstream end of the chute. Accordingly, the sheet is conveyed without being disturbed by a joint portion between the chute and the conveyance path.

An image forming apparatus includes a chute which is provided in the middle of a conveyance path for conveying each sheet and which is formed so that a width of the chute crossing a direction of conveyance of the sheet is tampered toward a downstream side with respect to the conveyance direction; and a roller which is provided in a most downstream side of the chute with respect to the conveyance direction of the sheet so that the roller conveys the sheet from the chute to the conveyance path.

Accordingly, the roller is provided on the most downstream side of the chute with respect to the sheet conveyance path. Thus, there is no level difference formed between the roller and the chute on the downstream side of the roller, as in the case where, for example, the roller is formed in the middle of the chute. Thus, collision noise can be restrained from being caused by collision of the sheet with the chute after the sheet passes through the roller.

According to exemplary embodiments of the present invention, it is possible to prevent collision noise of each sheet in an image forming apparatus.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a chute, including:

an upstream edge; and a downstream edge which is opposite the upstream edge with respect to the sheet conveyance direction; and a roller, wherein the upstream edge includes a most upstream edge of the chute and the downstream edge includes a most downstream edge of the chute, wherein the chute is provided in a middle of a conveyance path for conveying a sheet and which is formed so that a width of the chute crossing a sheet conveyance direction is tapered along the downstream edge, wherein the roller which is provided at a most downstream portion of the downstream edge of the chute with respect to the sheet conveyance direction, so that the roller conveys the sheet from the chute to the conveyance path, and wherein the chute is inclined with respect to the sheet conveyance direction, and the incline is curved such that the incline is not constant throughout the chute along the sheet conveyance direction.

2. An image forming apparatus according to claim 1, wherein the chute is formed symmetrically with respect to a widthwise direction perpendicular to the sheet conveyance direction.

3. An image forming apparatus according to claim 1, further comprising:

a guide member which guides the sheet from the roller to the conveyance path while sliding the sheet in a position on a downstream side of the roller with respect to the sheet conveyance direction.

4. An image forming apparatus according to claim 3, wherein a driving roller driven by a drive source is provided in a state in which a rotary shaft of the driving roller is fixed;

the roller is a driven roller which is provided separately from the driving roller and which comes into contact with the driving roller so that the driven roller is driven to rotate in accordance with rotation of the driving roller;

the driven roller is disposed in a holding member which holds the driven roller to allow the driven roller to rotate;

the holding member has a support mechanism which supports the holding member swingably so that a rotary shaft of the driven roller and the rotary shaft of the driving roller are substantially parallel to each other while the driving roller and the driven roller come into contact with each other; and the guide member is provided in the holding member.

5. An image forming apparatus according to claim 3, wherein the guide member is shaped like a rib extending in the sheet conveyance direction; and the conveyance path has a recess portion which is formed in a position corresponding to the guide member so that the recess portion receives the guide member.

6. An image forming apparatus according to claim 3, wherein the guide member is formed to protrude toward a downstream side of a track in which a trailing end of the sheet is shifted to the conveyance path from the roller with respect to the conveyance direction when the trailing end of the sheet goes out from the roller.

7. An image forming apparatus according to claim 3, wherein the guide member performs positioning of the roller in a rotary shaft direction of the roller.

8. An image forming apparatus according to claim 1, wherein the roller is configured to remove foreign matter deposited on a surface of the sheet.

9. An image forming apparatus according to claim 1, further comprising:

a pressing plate that is provided at an upstream side of the chute in the sheet conveyance direction and is configured to press the sheet toward a feed roller.

10. An image forming apparatus according to claim 1, wherein the downstream end of the chute is convex in the sheet conveyance direction.

11. An image forming apparatus according to claim 1, wherein the downstream end of the chute is tapered such that the tapering begins at the outermost edges of the chute relative to the width of the chute crossing the sheet conveyance direction.

12. An image forming apparatus comprising:

a chute which is provided in a middle of a conveyance path for conveying a sheet and which is formed so that a width of the chute crossing a sheet conveyance direction is tapered in a downstream side with respect to the sheet conveyance direction; and a roller which is provided at a most downstream side of the chute with respect to the sheet conveyance direction so that the roller conveys the sheet from the chute to the conveyance path, wherein the chute is inclined with respect to the sheet conveyance direction, wherein the incline is curved such that the incline is not constant throughout the chute along the sheet conveyance direction.

13. An image forming apparatus according to claim 12, further comprising a separation pad, wherein the separation pad is provided at the most upstream side of the chute with respect to the conveyance direction.

14. An image forming apparatus comprising:

a chute which is provided in a middle of a conveyance path for conveying a sheet and which is formed so that a width of the chute crossing a sheet conveyance direction is tapered in a downstream side with respect to the sheet conveyance direction; and a roller which is provided at a most downstream side of the chute with respect to the sheet conveyance direction so that the roller conveys the sheet from the chute to the conveyance path, wherein the downstream end of the chute is convex in the sheet conveyance direction.

15. An image forming apparatus according to claim 14, further comprising a separation pad, wherein the separation pad is provided at the most upstream side of the chute with respect to the conveyance direction.

* * * * *